US006216943B1

(12) United States Patent
Ryan

(10) Patent No.: US 6,216,943 B1
(45) Date of Patent: Apr. 17, 2001

(54) FRESH FOLD PACKAGE

(75) Inventor: Michael Ryan, County of Delaware, PA (US)

(73) Assignee: Smurfit-Stone Container Corporation, Phoenixville, PA (US)

( * ) Notice: Subject to any disclaimer, the term of this patent is extended or adjusted under 35 U.S.C. 154(b) by 0 days.

(21) Appl. No.: 09/541,641

(22) Filed: Apr. 3, 2000

(51) Int. Cl.[7] ..... B65D 5/56

(52) U.S. Cl. ..... 229/117.32; 229/117.33; 229/117.34; 53/456; 53/467; 53/491; 493/100

(58) Field of Search ..... 229/117.27, 117.32, 229/117.33, 117.34, 164.2; 220/FOR 173, FOR 174; 53/455, 456, 467, 491; 493/100, 114

(56) References Cited

U.S. PATENT DOCUMENTS

| | | | | |
|---|---|---|---|---|
| 2,216,527 | * | 10/1940 | Weiss et al. | 229/117.34 |
| 2,292,653 | | 8/1942 | Palmer . | |
| 2,307,559 | | 1/1943 | Angus . | |
| 2,321,681 | | 6/1943 | Hultin . | |
| 2,500,466 | | 3/1950 | Myers . | |
| 2,979,247 | * | 4/1961 | Pellaton et al. | 229/117.33 |
| 3,079,060 | | 2/1963 | Cherrin . | |
| 3,459,357 | | 8/1969 | Egger . | |
| 3,836,037 | | 9/1974 | Bass . | |
| 4,032,060 | | 6/1977 | Bergstein . | |
| 4,099,665 | * | 7/1978 | Bergstein | 229/117.34 |
| 4,403,837 | | 9/1983 | Nakashashi . | |
| 4,638,912 | * | 1/1987 | Graf | 229/117.33 |
| 4,660,737 | | 4/1987 | Green . | |
| 4,679,701 | | 7/1987 | Ackerman . | |
| 4,872,588 | * | 10/1989 | Texidor | 229/117.34 |
| 4,948,266 | | 8/1990 | Bencie . | |
| 4,969,596 | * | 11/1990 | Schulbaum | 229/117.27 |
| 5,094,359 | * | 3/1992 | DeMars et al. | 229/117.32 |
| 5,275,332 | | 1/1994 | Heuberger . | |

* cited by examiner

*Primary Examiner*—Gary E. Elkins
(74) *Attorney, Agent, or Firm*—Paul M. Denk

(57) ABSTRACT

A gabled, gussetted resealable lined container having an outer carton with foldable closure flaps and a liner within the carton. The upper inner surfaces of the liner are releasably sealed together after filling with product and the upper outer edges adhered to the closure flaps on the carton whereby when the closure flaps are opened, the inner liner is pulled opened and when the closure flaps are closed, the inner liner is resealed to maintain product freshness.

10 Claims, 5 Drawing Sheets

FRESH FOLD PACKAGE

CROSS REFERENCE TO RELATED APPLICATIONS

None

BACKGROUND OF THE INVENTION

This invention relates generally to paperboard containers and more particularly to a gabled container having reclosable end closure flaps and resealable inner bag in combination through which when opened the container and the sealed inner bag are simultaneously opened and, when closed, reseals the inner bag.

Prior art reclosable paperboard containers are known to the art. A number of folded containers are known to the prior art which include inner liners as well. For example, U.S. Pat. No. 2,292,653, to Palmer, shows a package having an inner container. U.S. Pat. No. 2,307,559, to Angus, shows a typical combined bag and box. U.S. Pat. No. 2,321,681, to Hultin, provides for a carton with a flat top and liner assembly as does U.S. Pat. No. 3,459,357, to Egger et al. U.S. Pat. No. 4,032,060, to Bergstein, provides for a carton with a self-sealing end closure which lies within the confines of the closure and U.S. Pat. No. 4,6609,737, shows a carton and pouch system. U.S. Pat. No. 4,679,701, to Ackerman et al, does not show a carton, but an envelope-type container with an inner bag. The two lateral walls of the outer envelope have no moving parts.

None of the prior art provides for a gusseted, gabled container having fold over closure flaps which extend above the confines of the container and run the length of the gable which opens the inner line when opened and, when closed, seals the inner liner thereby offering the advantages of double sealing to keep the contents of the container fresh.

SUMMARY OF THE INVENTION

It is among the various objects of the present invention to provide a paperboard container which can be resealed to keep the contents fresh.

It is another object of the present invention to provide such a container that has a resealable inner liner.

Another object of the invention is to provide such a container that has a gusseted, gabled configuration whereby the closure extends above the confines of the container.

Another object of the invention is to provide such a container that has closure flaps which extend the length of the gable which can fold over and seal the container.

Still another object of the invention is to provide a lightly sealed inner liner, the upper walls of which are adhered to the closure flaps whereby when the flaps are opened, they simultaneously open this inner liner.

In accordance with the invention, generally stated, a gusseted, gabled resealable lined container is provided having opposing side body panels and narrower opposing end panels defining an inner chamber. The tops of the end panels each termination in a gusset. The upper ends of side body panels are connected by the gussets so that when the gussets are folded, the upper ends of the side body panels angle inwardly forming a gable. An opposing pair of sealing flaps extend the length of the body panels forming a ridge along the gable. A liner can be positioned in the inner chamber of the container. The upper end of the inner liner, when filled and sealed, assumes a complementary gabled configuration. The upper gabled end of the sealed liner extends out of the chamber. The top sealing flaps adhere to the top of the liner so that when the sealing flaps are opened, the sealed liner is pulled open. When the container is closed, the sealing flaps are folded over one side of the gable, securing the closed liner therebetween for sealing.

BRIEF DESCRIPTION OF THE DRAWINGS

Corresponding reference numerals indicate corresponding structures throughout the various drawings.

DETAILED DESCRIPTION OF THE INVENTION

Figure 1:
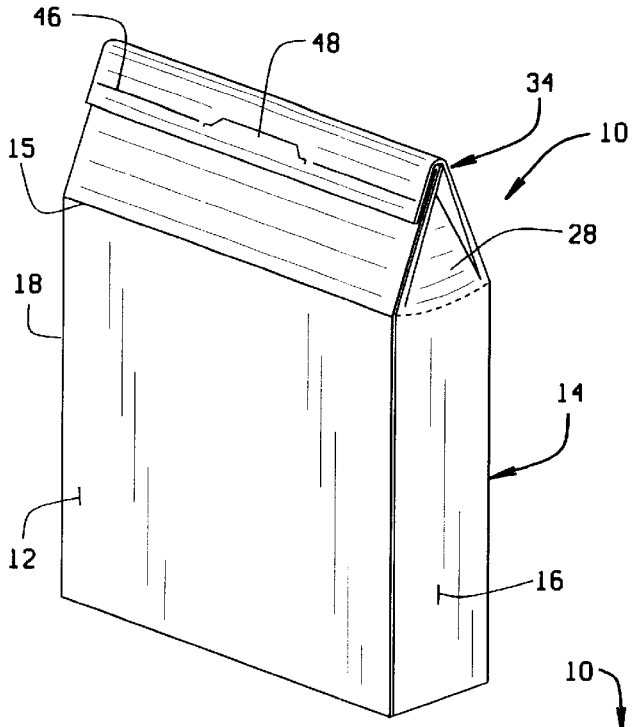
FIG. 1 is an isometric view of the gabled resealable lined container of the present invention in a closed, sealed gabled configuration.

The gabled resealable lined container of the present invention is indicated generally in the drawings by reference number 10. It will be appreciated that the container 10 is designed as a container for any number of products to maintain freshness and purity. For example, container 10 can contain storage and use food products for man or beast, such as cereals, snacks, condiments of the like. Furthermore, the container can be used for non-edible products which may be granular or powdered chemicals. Hence, the ultimate contents of container 10 are not necessarily related to the scope of the invention.

Figure 3:
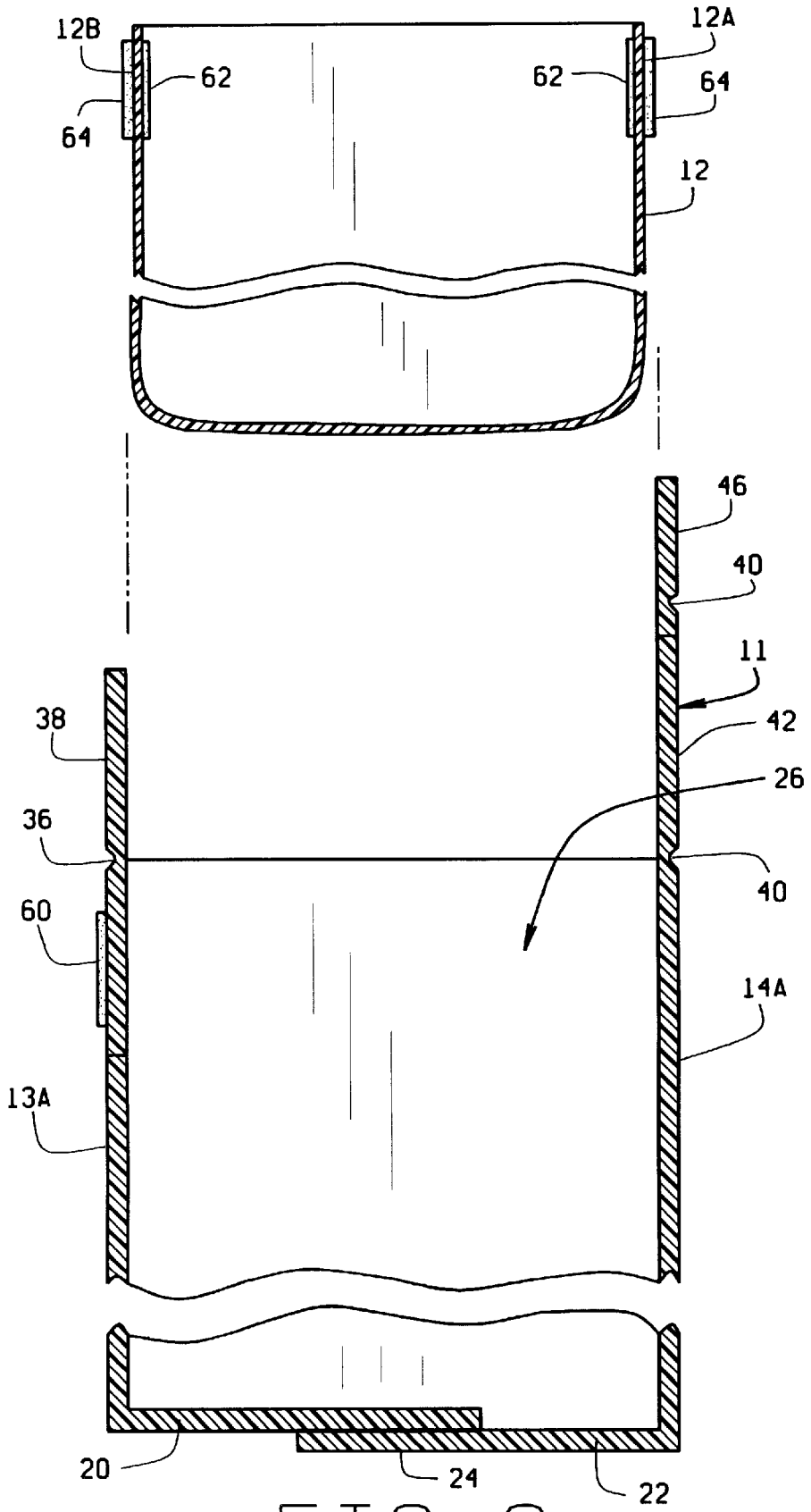
FIG. 3 is a cross sectional, exploded view of gable resealable lined container of the present invention showing the relationship between the liner and the container carton.

It will be appreciated by those skilled in the art that container 10 includes an outer semirigid carton 11 with an inner liner 12. The carton 11 is constructed from a folded paper board blank (not shown) which is conventionally stamped from sheet stock using a cutting die as is known to the art. Carton 10 includes first side wall 13 and a second opposed side wall 14 (FIGS. 3,5*a*). The side walls 13 and 24 include fold lines 15 which allow the upper portions 13A and 14A of side walls 13 and 14 respectively, to be folded inwardly, as shown in FIG. 1 and as will be explained below. The carton 12 includes a first end wall 16 and an opposed, identical second end wall 18. It will be noted in the illustrated embodiment, the side walls 13 and 14 have a greater width than the end walls 16 and 18. However, the walls can be constructed in any acceptable dimensions. As shown in FIG. 3, first side wall 13 includes, at a lower end, a bottom wall flap 20. Second side wall 14 also includes, at a lower end, a bottom wall flap 22. The bottom wall flaps 20 and 22 are folded into an overlapping relationship and glued or appropriately secured to create a bottom wall 24. The first and second side walls 13 and 14, the end walls 16 and 18 and bottom wall 24 define an inner carton chamber 26.

Figure 2:
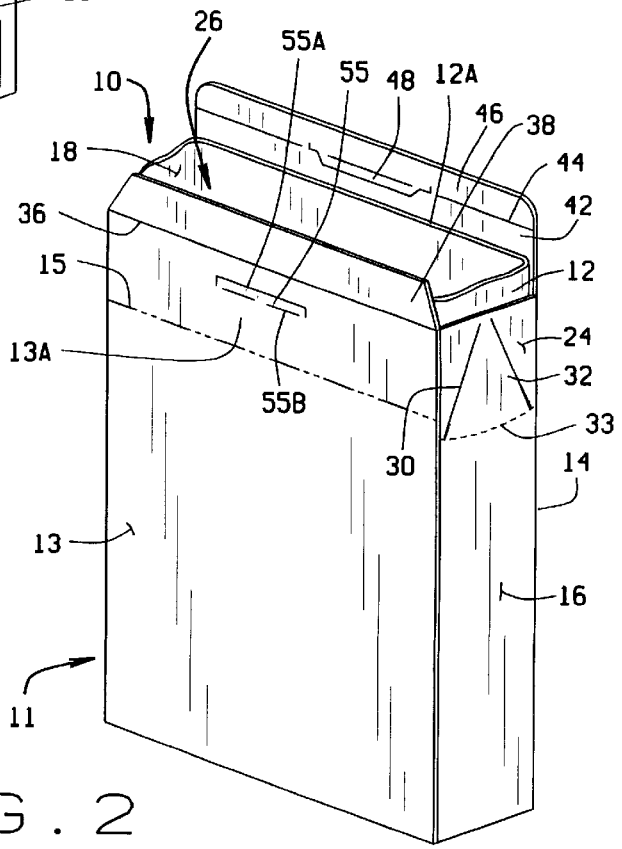
FIG. 2 is an isometric view of the gabled resealable lined container of the present invention in an open configuration.

As shown in FIG. 1, each end wall 16 and 18 includes, at the top edge, a gusset 28. Gusset 28 includes a first inwardly angled fold line 30 and a second inwardly angled fold line 32. See also, FIG. 2. The gussets 28 at the top of each end wall allow the tops of the end walls to be folded inwardly, thus drawing the top portions 13A and 14A of side walls 13 and 14 respectively, inward to form a gable indicated generally by numeral 34. It can be seen that a curved scored gusset line is provided at 33.

Figure 7:
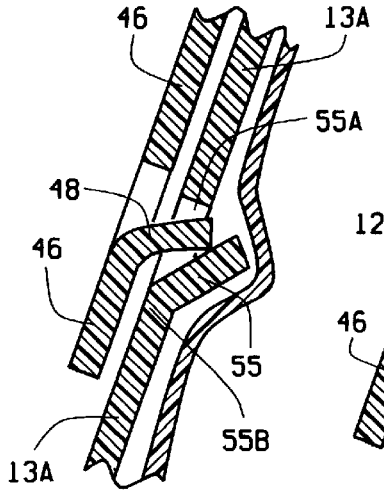
FIG. 7 is an enlarged partial cross sectional view of the locking tab feature of the closure for the gabled resealable lined container of the present invention.
Figure 4:
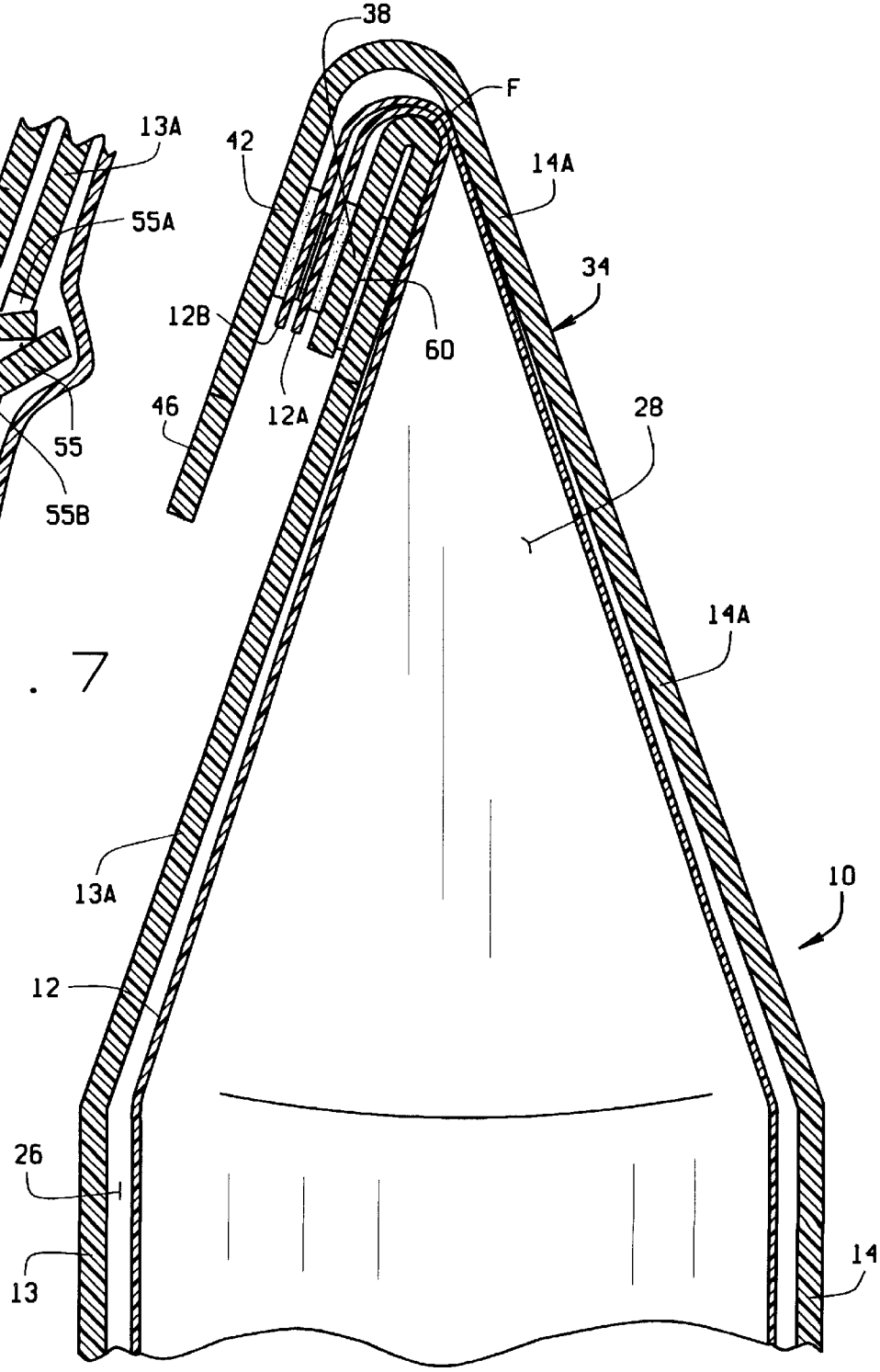
FIG. 4 is an enlarged, cross sectional view of the access end of the gabled resealable lined container of the present invention in a closed and sealed configuration.

The upper portion 13A of side wall 13 includes a fold line 36 defining a sealing flap 38. The upper portion 14 A of side wall 14 includes a fold line 40 defining a first sealing flap 42. To provide for sealing, a first sealing flap 42 includes a fold line 44 which defines a second sealing flap 46. A locking tab 48 is formed at the fold line 44. The locking tab 48 is positioned to engage a locking tab slot 55 formed in the upper segment 13A of side wall 13 when the container is in a closed and locked configuration, as shown in FIG. 1. Slot 55 is formed by a Π shaped slit 55A through the paperboard and fold line 55B. The relationship between the locking tab 44 and slot 55 is shown in greater detail in FIG. 7. As can be appreciated, the locking tab 48 can be inserted into slot 55 and engaging wall segment 13A. It will be noted that this tab-slot locking arrangement is designed to be used after the container is opened the first time to keep the container 10 closed. It will be understood that when the container is filled for the first time, by the manufacturer, the sealing flaps are adhered to the wall segment 13A with an appropriate adhesive 60, as illustrated in FIG. 4, and as will be explained below.

Figure 6:
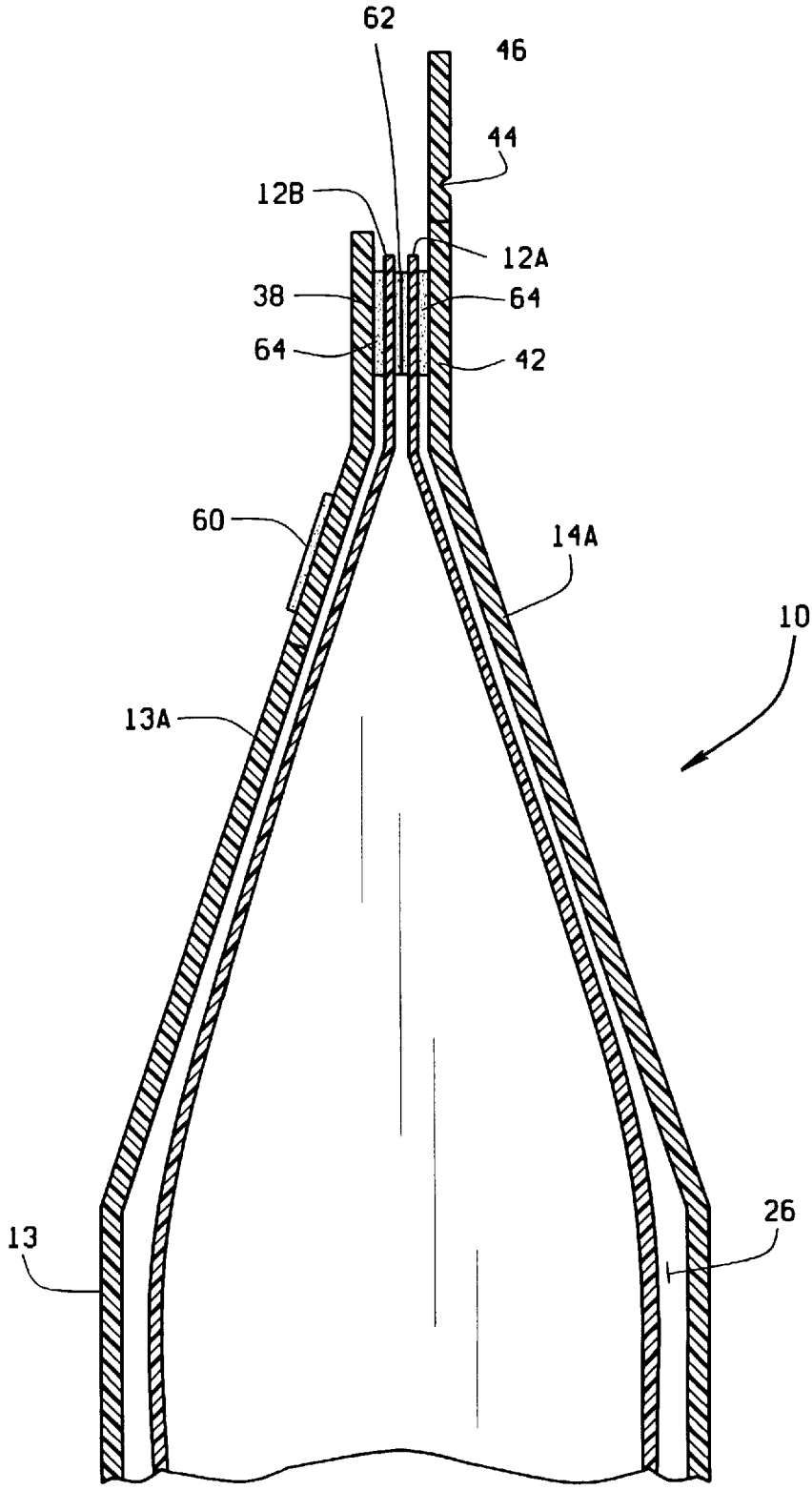
FIG. 6 is an enlarged, cross sectional view of the access end of the gabled resealable lined container of the present invention in a closed configuration with the outer closure opened with the inner liner remaining sealed.

As stated previously, the container 10 includes an inner liner 12. Inner liner 12 is a lightly sealed or an open ended bag or the like configured having contiguous side walls and a bottom to rest within chamber 26. It will be appreciated that line 12 is constructed from a durable, moisture and air resistant material such as waxed paper, cellophane, foil or any appropriate material. During production the liner 12 is filled with desired contents. The inner surfaces of upper edges 12A and 12B then are sealed together, if it is an opened liner, as shown in FIG. 6 by a light adhesive 62. The adhesive 62 can be any appropriate adhesive that will secure the upper edges to the liner together The filled liner 12 is inserted into chamber 26. The gussets 28 are collapsed inwardly drawing the upper segments 13A and 14A of the side walls into the gabled configuration. The sealing flap 38 and sealing flap 42 are adhered to the outer surfaces 12 and 12A respectively with an adhesive 64. (F. 6). As illustrated in FIG. 3, the adhesive 64 is designed to have greater adhesive strength than adhesive 6*s* of adhesive 60. The various sealing flaps are folded over, as shown in FIG. 4, and sealing flap 38 is adhered to upper side wall segment 13A. Due to the presence of adhesives 60, 62 and 64 the container 10 is sealed in a closed configuration for shipment and storage.

Figure 5:
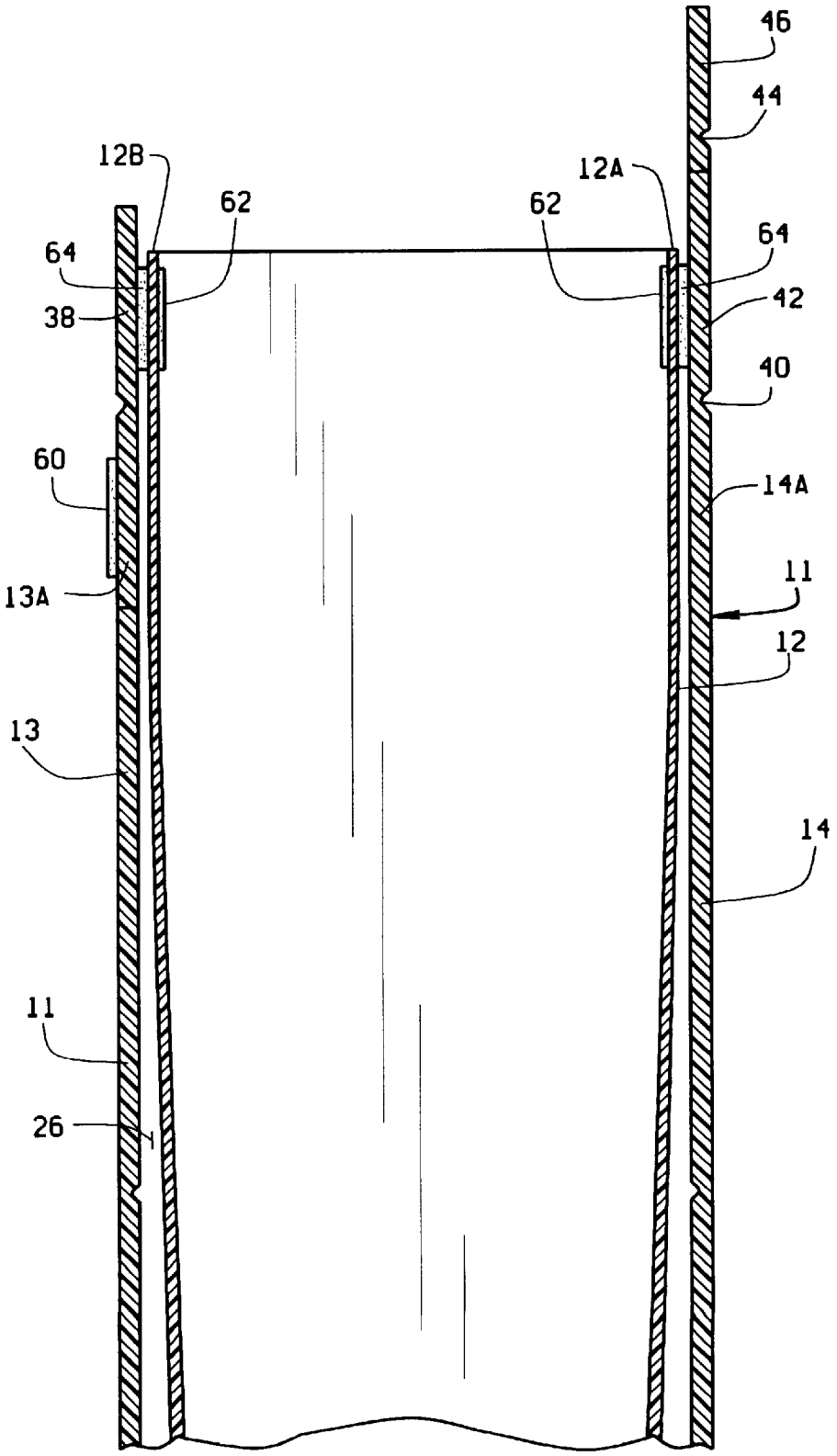
FIG. 5 is an enlarged, cross sectional view of the access end of the gabled resealable lined container of the present invention in an opened configuration.

In use, the consumer can grasp flap 46 and pull sealing flap 38 away from adhesive 60 and move the various sealing flaps into an upright or rigid configuration as shown in FIG. 6. The user can then grasp flaps 38 and 46 and exert an outward pressure to break the seal between upper liner edges 12A and 12B. Since the adhesive strength of adhesive 64 is greater than that of adhesive 62, the upper edges 12A and 12B of line 12 will remain adhered to flaps 38 and 42 respective and allow the liner to be pulled open for access to the contents as shown in FIG. 5.

To close the container after access and use, the gussets 28 are collapsed and the gable formed. Because adhesive 62 retains its adhesive properties, the upper edges of the liner are resealed. The various sealing flaps are folded into their closed position (FIG. 4). The upper edges 12A and 12B of the liner 12 are sandwiched between flaps 38 and 42. Moreover, the liner is pinched at the flap fold area F to more completely seal the liner, resulting in a closed container that retains the freshness of its contents by forming relatively air impervious seals between the liner edges 12A and 12B, as well as at fold area F. When closed after the first usage, the various flaps are secured in their folded and sealed arrangement by inserting tab 48 into slot 55.

It will be appreciated by those skilled in the art, various changes and modifications may be made in the container of the present invention without departing from the scope of the appended claims. Therefore, the foregoing description and accompanying drawings are intended to be illustrative only and should not be construed in a limiting sense.

What is claimed is:

1. A gabled resealable container comprising:

a pair of opposed side panels;

a pair of opposed end panels, said side panels and end panels together with a bottom panel defining an inner chamber;

a pair of opposed top sealing flaps, one each of said flaps positioned along the transverse length of and extending above a top edge of each of said side panel;

a gusset fold at the top of each end panel, each said gusset being connected to the top of each of said opposed side panels whereby when said gussets are in a folded position said side panels are folded inward forming a gable;

a liner within said chamber, said liner having a first wall and a second wall each having an upper edge, one of each said upper edges of said first and second liner walls being nonreleasably affixed to one each of the top sealing flaps, the liner walls being releasably affixed to each other when the container is in a closed configuration.

2. The gabled resealable lined container of claim 1 wherein said first and second walls of said liner are releasably adhered to each other when said side panels are folded inward forming said gable and pulled apart to form an opening when the top sealing flaps are pulled apart.

3. The gabled resealable line container of claim 1 wherein said top sealing flaps are foldable over one side of said gable to seal the container.

4. The gabled resealable lined container of claim 1 wherein said first side panel includes a locking tab slot and said first sealing flap includes a locking tab for releasable engagement in said locking tab slot when the container is in a closed configuration.

5. A resealable container comprising:

an outer carton, said carton including a first side panel and a second side panel, a first end panel and a second end panel and a bottom panel, said respective panels defining an inner chamber;

a first sealing flap extending transversely along an upper edge of said first side panel;

a second sealing flap extending transversely along an upper edge of said second side panel;

a third sealing flap extending transversely along an upper edge of said second sealing flap;

a liner positioned within said chamber, said liner having a first upper edge adhered to said first sealing flap, and a second upper edge adhered to said second sealing flap, said first and second upper edges of said liner being releasably adhered to each other when the container is in a closed position, whereby said liner be opened for access by exerting an outward force on said first and third sealing flaps thereby pulling apart the releasably adhered first and second upper edges of said liner.

6. The resealable container of claim 5 wherein said first end panel includes a first gusset at an upper edge and said second end panel includes a second gusset at an upper edge, said first gusset foldably connecting said first end panel and said first and second side wall and said second gusset foldably connecting said second end panel and said first and second side wall whereby the folding of said respective gussets forms a gable at a top of the container.

7. The resealable container of claim 6 wherein said second and third sealing flaps are folded over said first sealing flap to secure the container in a closed configuration.

8. The resealable container of claim 7 wherein said first upper liner edge and said second upper liner edge are secured and sealed between said first sealing flap and said second sealing flap when the container is in a closed position.

9. The resealable container of claim 7 wherein said liner is compressed and sealed at a fold area between said first side panel and said second side panel when the container is in a closed position.

10. A process for constructing a gabled lined container comprising:

constructing an outer carton from a paperboard blank, said outer carton including a first side panel, a second side panel, a first end panel, a second end panel and a bottom panel, said respective panels defining an inner chamber;

said first side panel including a first sealing flap along an upper edge thereof, said second side panel including a second sealing flap along an upper edge thereof;

said second sealing flap including a third sealing flap along an upper edge thereof;

said first end panel including a first gusset at an upper edge thereof and said second end panel including a second gusset at an upper edge thereof;

constructing an inner liner having a first and second wall each wall having an upper edge, the upper edges of said liner defining an opening;

placing the contents of the container into said liner;

releasably adhering an inner surface of the upper edge of the first liner wall to an inner surface of the upper edge of the second liner wall;

positioning said releasably adhered liner and its contents into the carton chamber;

collapsing said first and second gussets thereby folding said first and second wall panels inwardly to form a gable;

adhering an outer surface of said first liner wall upper edge to said first sealing flap;

folding said first sealing flap and said second sealing flap, with the upper edges of the first and second liner walls therebetween, onto said first wall panel;

securing said third sealing flap to said first wall panel thereby securing said carton and liner in a sealed closed position.

* * * * *